United States Patent [19]

McCaffrey

[11] Patent Number: 4,735,549

[45] Date of Patent: Apr. 5, 1988

[54] BILLET TURNING DEVICE

[75] Inventor: Felim McCaffrey, Toronto, Canada

[73] Assignee: Hatch Associates Ltd., Toronto, Canada

[21] Appl. No.: 55,985

[22] Filed: Jun. 1, 1987

[51] Int. Cl.[4] ..... B21B 39/20

[52] U.S. Cl. ..... 414/783; 198/403; 198/411; 414/758

[58] Field of Search ..... 414/754, 758, 761, 762, 414/763, 764, 767, 768, 773, 779, 780, 781, 782, 783; 198/403, 411

[56] References Cited

U.S. PATENT DOCUMENTS

| | | | |
|---|---|---|---|
| 1,152,014 | 8/1915 | Farkell | 198/403 |
| 3,759,401 | 9/1973 | Kreuz et al. | 414/781 X |
| 3,933,253 | 1/1976 | Gardner | 414/783 |
| 4,074,815 | 2/1978 | Varwig | 198/413 X |
| 4,368,815 | 1/1983 | Kvasnicka | 198/413 |
| 4,424,000 | 1/1984 | Sucato | 414/780 |

FOREIGN PATENT DOCUMENTS

| | | | |
|---|---|---|---|
| 1568207 | 5/1980 | United Kingdom | 414/754 |
| 141467 | 11/1961 | U.S.S.R. | 414/780 |
| 1054236 | 11/1983 | U.S.S.R. | 414/754 |

*Primary Examiner*—Leslie J. Paperner

*Attorney, Agent, or Firm*—Ridout & Maybee

[57] ABSTRACT

A portable device is provided for turning billets supported on stands for inspection. The device has a frame, a crank arm mounted in the frame for movement through a quadrant by a hydraulic cylinder, a billet engaging bracket on the end of the crank, and further billet engaging frames extending from the frame to either side of the crank so as to sustain on adjacent billets the reaction from the crank arms as its bracket turns a billet. The turning action is improved by inclusion of a lost motion link between the crank arm and the cylinder. To make the device easier and lighter to handle, it is spring suspended from a movable stand which also supports a power pack for operating the cylinder.

9 Claims, 4 Drawing Sheets

BILLET TURNING DEVICE

This invention relates to the turning of metal billets and other elongated metal workpieces.

When steel billets are produced, it is necessary to turn the billets on supports in order that they may be inspected, and any necessary action taken to grind away surface blemishes. This turning has traditionally been carried out manually using pinch bars or F-wrenches, which is a strenuous, unpleasant and extremely dangerous task. Mechanization of the process has been difficult, since handling equipment such as crane operated electromagnets are very clumsy and difficult to use for this purpose, which merely entails tipping the billets from face to face, and purposebuilt inspection tables with built in billet turning facilities are very complex and expensive, their cost only being justified in large plants. Typical examples of such inspection tables are shown in U.S. Pat. Nos. 3,759,401 (Kreuz et al), 4,074,815 (Varwig) and 4,368,815 (Kvasnicka).

U.S. Pat. No. 4,424,000 (Sucato) discloses a billet turning mechanism which is mounted by a truck on transverse rails at one end of an inspection table, and which can be manoeuvred into alignment with the ends of individual billets to turn the latter using a hydraulically operated crank mechanism. It is a bulky piece of equipment that requires permanent support tracks. U.S. Pat. No. 3,933,253 shows a trolley mounted device for turning structural sections which appears readily movable from place to place, and is provided with various means to adjust a set of jaws into engagement with the end of a section, the jaws then being rotated to turn the section. This unit however requires a satisfactory floor to support the trolley and a substantial amount of manipulation to align it with the end of a section.

Ideally, a more or less portable tool would be desirable for turning billets, which could be easily handled by one person and rapidly transferred from billet to billet as these are successively turned on an inspection table or stand. An object of the present invention is to provide such a tool.

According to the invention, a device for turning one of a plurality of generally parallel billets, supported for inspection in a horizontal plane, comprises a frame, a crank journalled in said frame for movement relative to the frame about a horizontal axis through an over centre quadrant, first billet engaging means attached to said crank above said axis and engageable at one end of the billet to be turned, actuator means acting between said crank and said frame to move said crank between opposite ends of said quadrant, and second billet engaging means extending from the frame and engageable with at least one other of said billets to sustain reaction from said frame to forces applied by said first billet turning means to said billet to be turned.

Preferably the effective weight of the device is low enough for it to be handled by a single person, and plural second billet engaging means are provided to ensure that the device can be engaged in reaction sustaining relationship with an end of at least one other of the billets. A low effective weight of the device may be achieved by resiliently suspending it from a movable stand which also carries a power pack for the actuator means.

Further features of the invention will become apparent from the following decription of a preferred embodiment with reference to the accompanying drawings, in which.

Figures 1, 2:
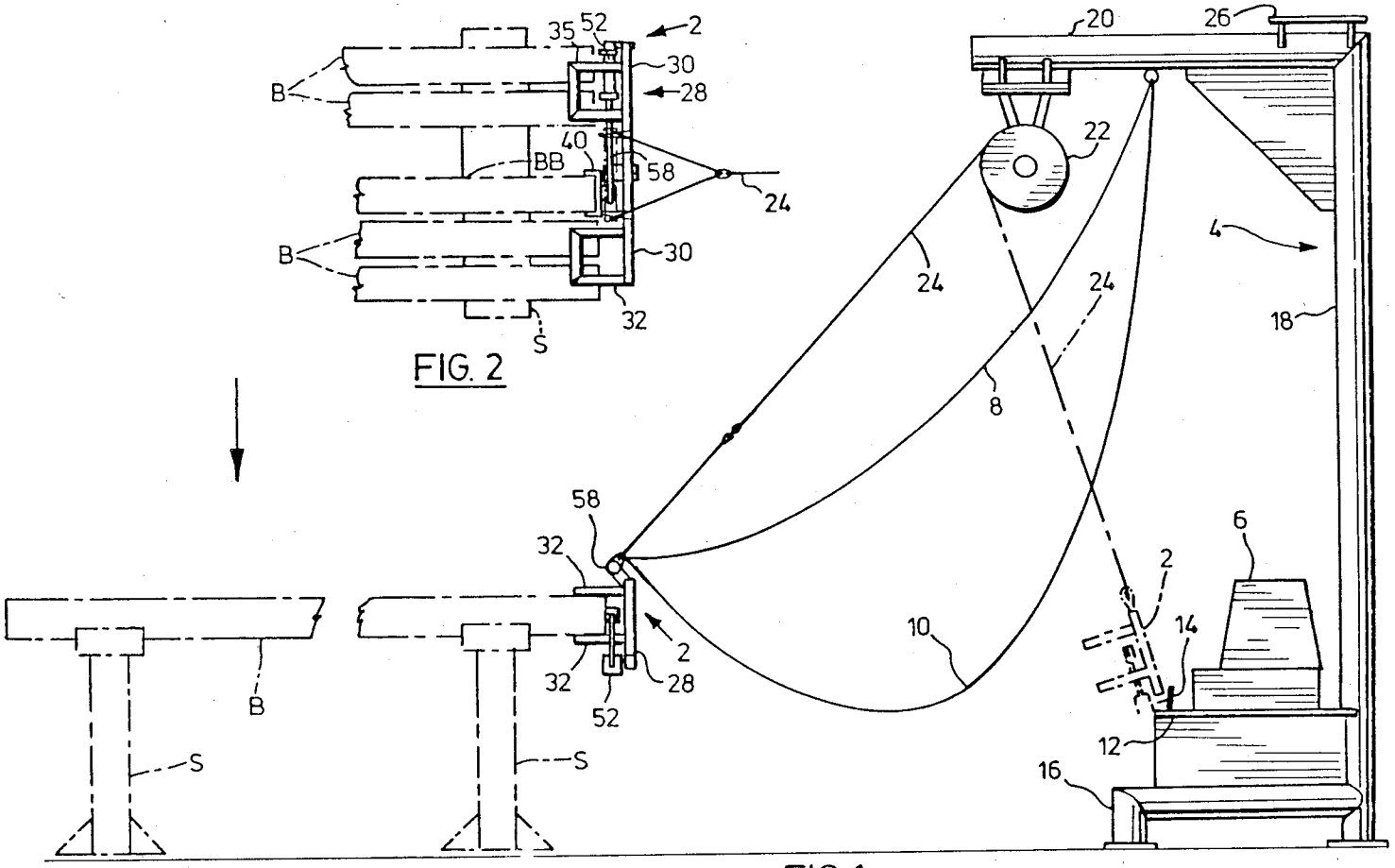
FIG. 1 is a side elevation illustrating billet turning apparatus in use.
FIG. 2 is a corresponding fragmentary plan view of the billet turning device proper.
Figure 3:
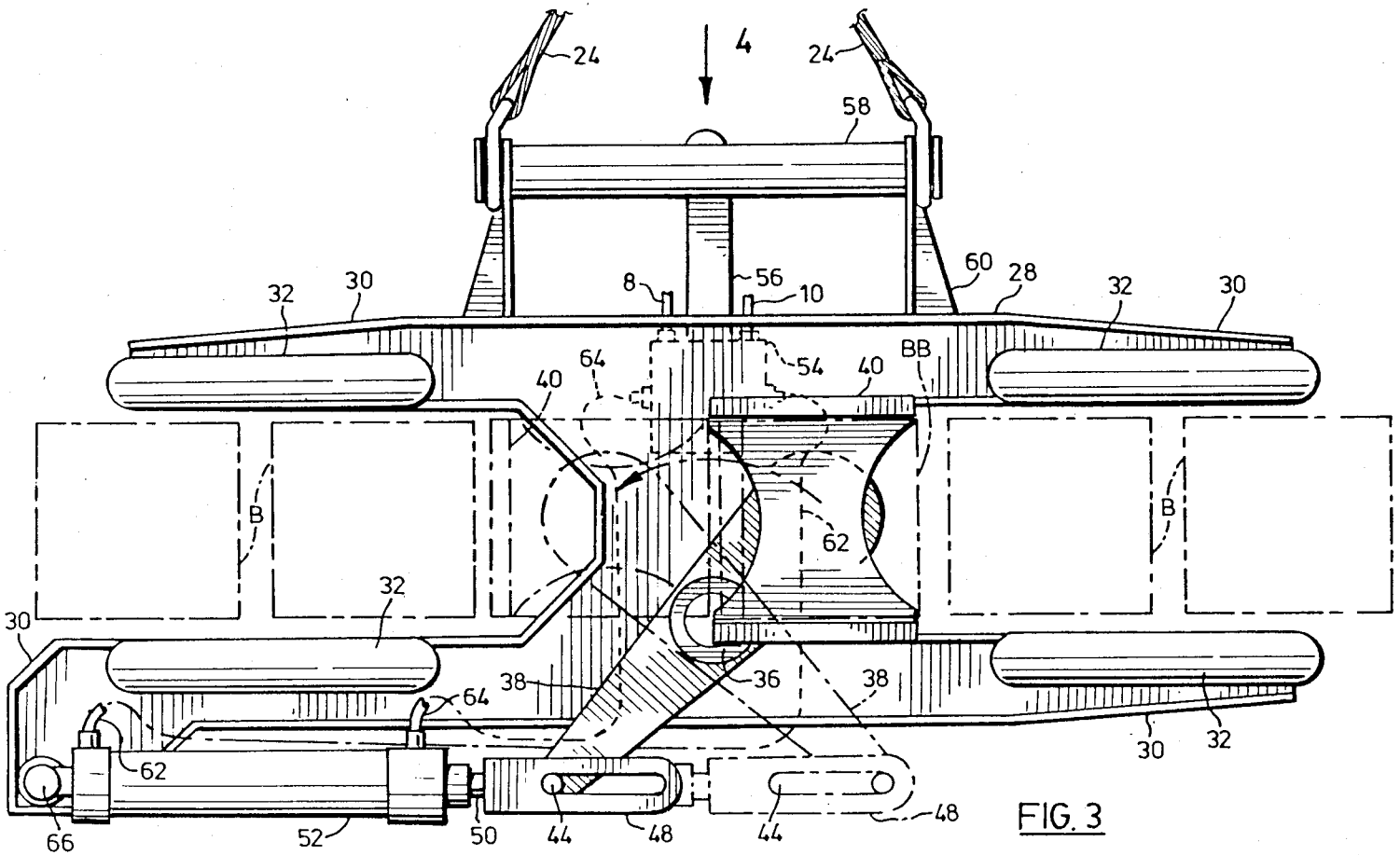
FIG. 3 is an elevation on an enlarged scale of the billet turning device as seen from the left in FIGS. 1 and 2.
Figure 4:
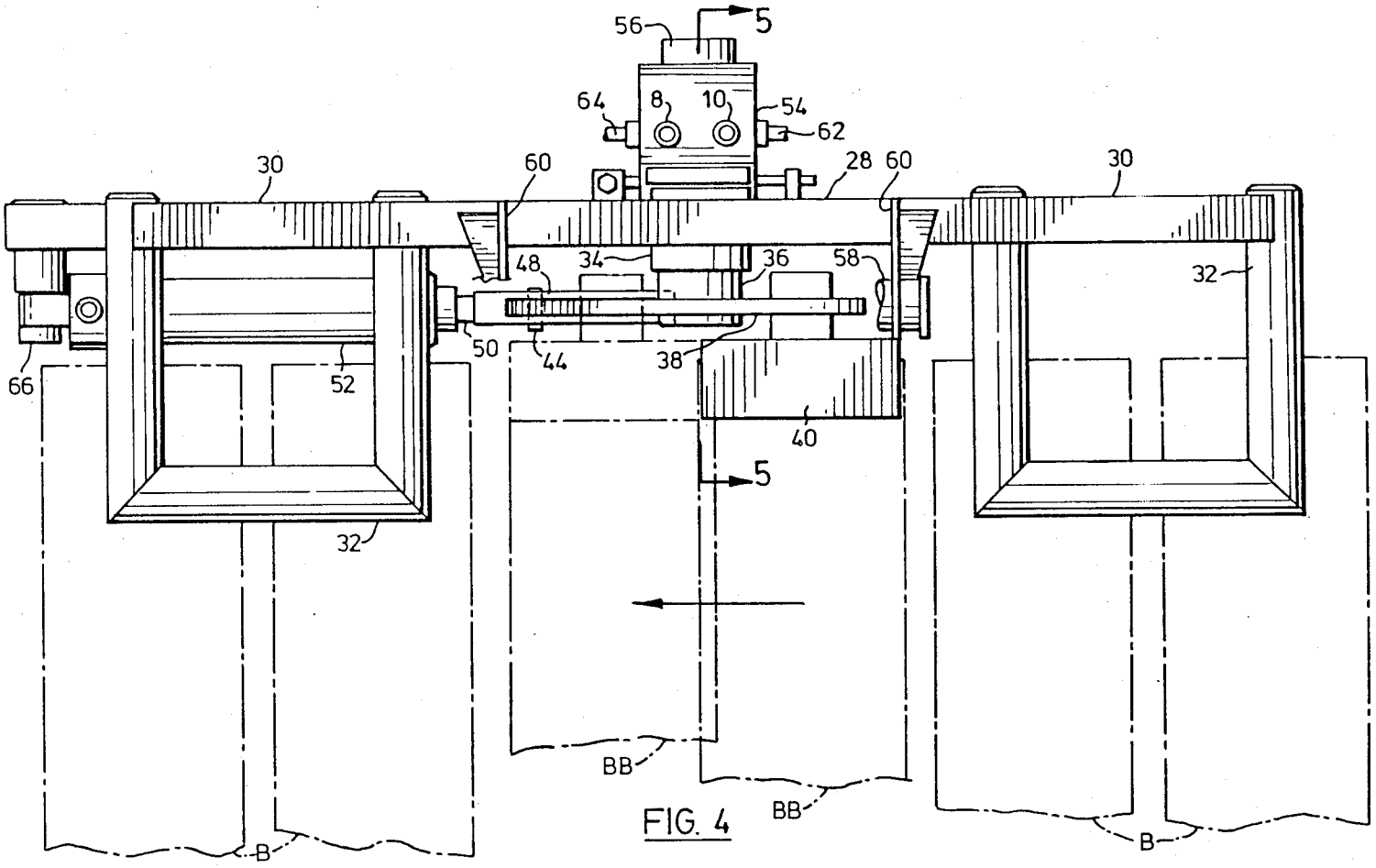
FIG. 4 is a plan view corresponding to FIG. 2, but on an enlarged scale.
Figure 5:
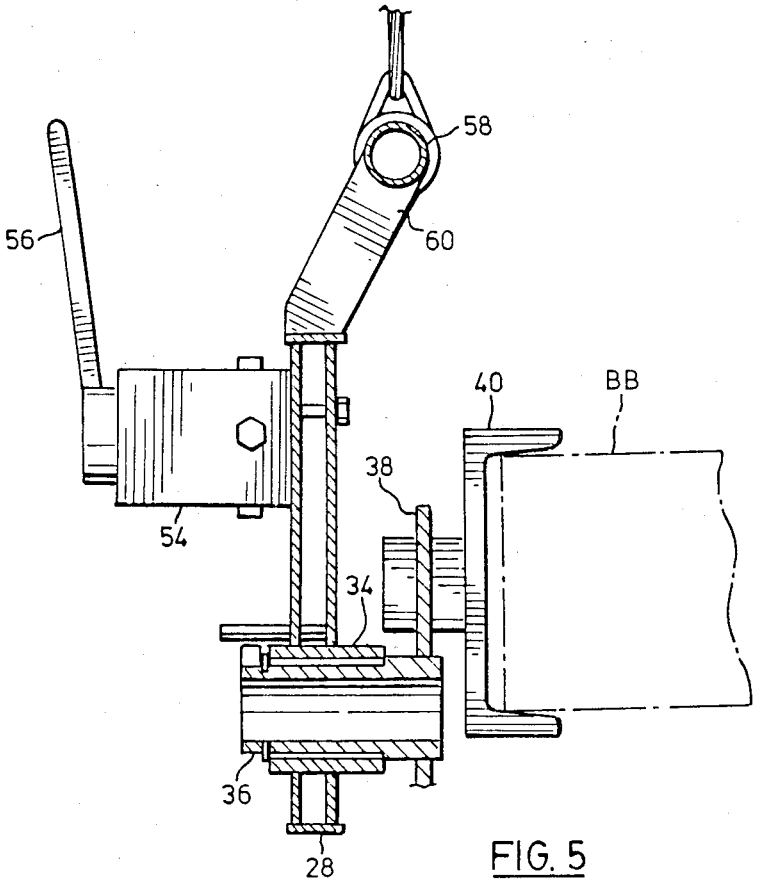
FIG. 5 is a section on the line 5—5 in FIG. 4.

Referring to FIG. 1, the apparatus comprises three main units, a billet turning device 2, a stand 4, and a power pack 6 on the stand. The power pack is of conventional construction and comprises a motor, and a hydraulic pump, reservoir and accumulator. Its function is to supply pressurized hydraulic fluid to the device 2 through a flexible hose 8, exhaust fluid returning through a flexible hose 10. The power pack is supported on a platform 12 on the stand 4, which platform also carried a hook 14 to which the device 2 may be anchored when not in use. The stand has a tripod base 16 and a column 18 supporting a canti-lever arm 20 at the outer end of which is suspended spring operated reel 22 for a support cable 24 attached to the device 2. The spring operated reel applies sufficient tension to the cable substantially to support the device 2 at a convenient working height, and to allow it to be moved laterally without substantial effort. The load taken by the cable allows a single person to handle the device 2, without placing undue constraints on the total weight of the latter. Without this load reduction, the permissible weight of the device 2 would be so limited that it would be difficult to produce a strong enough structure at reasonable cost. Since the power pack is required in any case, the stand provides not only a support for both the turning device and the power pack, but also a convenient means for positioning the apparatus. To this end, a horizontal steel plate 26 is attached to the arm 20 so that the entire stand may be lifted by a crane mounted electromagnet for relocation. Such a crane mounted electromagnet will usually be present in any case to handle billets B which are placed in parallel for inspection on stands 5. The tripod base of the stand means that it can be located even on rough or uneven ground and no track nor special base is required.

The device 2 comprises an H-shaped frame 28 in a vertical plane, the openings between the side bars 30 of the H being sufficient to pass the ends of any billets B which are longitudinally misaligned with adjacent billets. The ends of the side bars 30 each carry a laterally projecting horizontal tubular frame 32 configured to engage the upper or lower surface of at least one billet B parallel to an actual billet BB to be turned. The stem portion of the frame comprises at its lower end a journal 34 for a crank pin 36 of a crank arm 38, an upper end of which carries a channel shaped billet engagement bracket 40, a lower side 42 of which initially engages the underside of the billet BB. A lower end of the crank arm carries a thrust pin 44 which enters a slot 46 in a clevis 48 attached to a piston rod 50 of a hydraulic cylinder 52, connected by a pivot 66 at its other end to a side bar 30 of the frame 28. The cylinder 52 is connected by flexible hoses 62, 64 to a control valve 54 mounted on the frame and in turn connected to the hoses 8 and 10. The valve 54 has an actuating lever 56 controlling extension and retraction of the piston rod 50. The connection of the piston rod to the pin 44 through the slotted clevis 48 is such that either stroke of the piston rod will move the crank arm 38, and its bracket 40, over centre with respect to the crank pin 36, the stroke of the cylinder plus the length of the slot 46 being sufficient to permit the arm 38 to turn through a full quadrant. To assist in handling of the device, a handle 58 is attached to the frame by brackets 60, this handle also incorporating an anchorage for the cable 24.

In use, a group of billets B to be inspected is placed on the stands S with the billets lying parallel and with their ends in approximate alignment. The same crane mounted electromagnet (not shown) used to handle the billets is then used to position the stand 4 adajcent the one ends of the billets. An operator then unhooks the device 2 from the hook 14, operates the lever 56 if necessary so as to retract the piston rod 50 of cylinder 52, and applies the device to the ends of the billets B so that the channel bracket 40 engages the upper and lower surfaces of the end of a billet BB to be turned, and the frames 32 are adjacent the upper and lower surfaces of adjacent billets B. Whilst in the examples shown in the drawings there are billets B on both sides of the billet BB, this will not necessarily be the case, depending on the progress of the turning operation. Generally, a group of billets will be lying alongside each other initially, and starting with an end billet, each billet in sequence will be turned through 90°, the sequence being repeated at least three times so that each face of each billet will have faced upwardly at some time during the procedure. According to which billet is being turned, these will be adjacent billets B on either one or both sides of the billet BB, but in each case there will be frames 32 above and below at least one billet. The openings in the frame 28, which are deep enough to accommodate a billet, and the outward extent of the frames 32 beyond the bracket 40, mean that a certain amount of longitudinal misalignment of the billets can be tolerated. If the end of a billet BB to be turned projects well beyond the adjacent billets B so that the frames 30 cannot engage the latter, it will be necessary either to re-align the billets or to move the apparatus to the other end of the billets.

Once the device is engaged on the billet, the lever 56 is operated to actuate the cylinder 52, which swings the arm 38 and the bracket 40 through a quadrant such that the arm 38 moves over centre, and the lower wall of the bracket 40 lifts and the lower and upper brackets together tilt the billet BB until it tips over onto its adjacent face. The reaction from these lifting and tilting forces is sustained by the frames 32 acting on the billets B, and therefore the device requires no external support to sustain the turning forces. The lost motion provided by the slotted clevis 38 avoids a reversal of the reaction forces as the billet tips over centre, and allows the bracket 40 to move freely as the billet falls onto its next face. This both reduces the torsional forces applied to the bracket and substantially reduces the required stroke of the cylinder 52.

The device can then be withdrawn from the billet ends and the lever 56 operated to return the cylinder to its initial position, and move the arm 38 back over centre so that the bracket 40 falls back to a position for application to the end of a further billet.

I claim:

1. A portable device for turning one of a plurality of generally parallel billets supported for inspection in a horizontal plane, comprising a frame, a crank journalled in said frame for movement relative to the frame through an over centre quadrant about a horizontal axis, first billet engaging means attached to said crank above said axis and engageable at one end of said quadrant with an undersurface of the billet to be turned, actuator means acting between said crank and said frame to move said crank between opposite ends of said quadrant, and second billet engaging means extending from the frame and engageable with at least one other of said billets to sustain reaction from said frame to forces applied by said first billet turning means to said billet to be turned.

2. A device according to claim 1, having an effective weight low enough to be handled by a single person.

3. A device according to claim 2, including a suspension stand, and spring suspension means by which the frame of the device is supported from the stand so as to reduce its effective weight.

4. A device according to claim 1, wherein the actuator means is a hydraulic cylinder acting between and connected to said crank and said frame.

5. A device according to claim 4, including a hydraulic power pack, a control value on the frame of the device and connected to said actuator, and flexible hoses connecting said power pack to said control valve.

6. A device according to claim 3, wherein the stand includes a steel plate forming electromagnet engagement means.

7. A device according to claim 1, including a slotted link connecting the actuator means to at least one of said crank and said frame, such that movement of the crank through said over centre quadrant is the sum of the movement produced by said actuator means and the lost motion provided by said slotted link.

8. A device according to claim 1, wherein the frame is H-shaped and extends horizontally in a vertical plane, the openings between the side members of the H-shape being large enough to pass the end of a billet.

9. A device according to claim 8, wherein the second billet engagement means extend horizontally out of the plane of the frame from each end of each side member of the frame.

* * * * *